US011374305B2

(12) United States Patent
Tsou

(10) Patent No.: US 11,374,305 B2
(45) Date of Patent: Jun. 28, 2022

(54) ANTENNA STRUCTURE AND WIRELESS COMMUNICATION DEVICE USING THE SAME

(71) Applicant: Chiun Mai Communication Systems, Inc., New Taipei (TW)

(72) Inventor: Tun-Yuan Tsou, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 297 days.

(21) Appl. No.: 16/243,596

(22) Filed: Jan. 9, 2019

(65) Prior Publication Data

US 2019/0237852 A1 Aug. 1, 2019

(30) Foreign Application Priority Data

Jan. 11, 2018 (CN) ..... 201810026892.0

(51) Int. Cl.

| | |
|---|---|
| ***H01Q 1/24*** | (2006.01) |
| ***H01Q 5/35*** | (2015.01) |
| ***H01Q 1/48*** | (2006.01) |
| *H01Q 1/22* | (2006.01) |

(52) U.S. Cl.

CPC ..... *H01Q 1/243* (2013.01); *H01Q 1/48* (2013.01); *H01Q 5/35* (2015.01); *H01Q 1/2266* (2013.01)

(58) Field of Classification Search

CPC ..... H01Q 1/243; H01Q 5/35; H01Q 9/0421; H01Q 5/371; H01Q 1/48; H01Q 21/28; H01Q 1/2266

See application file for complete search history.

(56) References Cited

U.S. PATENT DOCUMENTS

| | | | | |
|---|---|---|---|---|
| 10,200,092 | B1 * | 2/2019 | Irei | H04B 7/0413 |
| 2009/0085812 | A1 * | 4/2009 | Qi | H01Q 1/243 29/601 |
| 2010/0007564 | A1 * | 1/2010 | Hill | H01Q 9/0421 343/702 |
| 2010/0053002 | A1 * | 3/2010 | Wojack | H01Q 9/0421 343/702 |

(Continued)

FOREIGN PATENT DOCUMENTS

| | | | |
|---|---|---|---|
| CN | 104064866 | A | 9/2014 |
| CN | 104914928 | A | 9/2015 |

(Continued)

*Primary Examiner* — Graham P Smith
*Assistant Examiner* — Jae K Kim
(74) *Attorney, Agent, or Firm* — ScienBiziP, P.C.

(57) ABSTRACT

An antenna structure utilizing metallic frame of electronic device to simultaneously send and receive radio waves on multiple frequencies includes first and second feeding sources and the metallic frame. A notch in the metallic frame creates first and second radiating portions. The first feeding source feeds the first radiating portion, and a first mode and a second mode can be activated simultaneously to generate radiation signals in a first frequency band and a second frequency band. The second feeding source feeds the second radiating portion and a third mode and a fourth mode can be simultaneously activated to generate radiation signals in a third frequency band and a fourth frequency band. A wireless communication device is also provided. The wireless communication device includes a motherboard and the antenna structure.

19 Claims, 13 Drawing Sheets

(56) References Cited

U.S. PATENT DOCUMENTS

2012/0206302 A1* 8/2012 Ramachandran ..... H01Q 1/42 343/866
2012/0223866 A1* 9/2012 Ayala Vazquez ..... H01Q 1/243 343/893
2012/0262345 A1* 10/2012 Kim ..... H01Q 21/28 343/702
2012/0262347 A1* 10/2012 Tiang ..... H01Q 1/243 343/702
2012/0299785 A1 11/2012 Bevelacqua
2013/0099984 A1* 4/2013 Jung ..... H01Q 7/00 343/702
2013/0135157 A1* 5/2013 Tsou ..... H04M 1/026 343/702
2013/0257659 A1* 10/2013 Darnell ..... H05K 1/028 343/702
2014/0218247 A1* 8/2014 Tefiku ..... H01Q 5/385 343/850
2014/0292590 A1* 10/2014 Yoo ..... H01Q 1/243 343/702
2014/0292598 A1* 10/2014 Bevelacqua ..... H01Q 9/0442 343/745
2014/0300518 A1* 10/2014 Ramachandran ..... H01Q 5/371 343/702
2014/0327584 A1* 11/2014 Chang ..... H01Q 5/378 343/702
2014/0333495 A1* 11/2014 Vazquez ..... H01Q 5/371 343/745
2014/0333496 A1* 11/2014 Hu ..... H01Q 9/0421 343/745
2014/0368398 A1* 12/2014 Ying ..... H01Q 1/521 343/841
2015/0005037 A1* 1/2015 Caballero ..... H04M 1/026 455/566
2015/0070239 A1* 3/2015 Hung ..... H01Q 1/48 343/848
2015/0084817 A1 3/2015 Yong
2015/0147984 A1* 5/2015 Ying ..... H04B 1/3827 455/90.3
2015/0249292 A1* 9/2015 Ouyang ..... H01Q 21/30 343/702
2015/0311579 A1* 10/2015 Irci ..... H01Q 13/10 343/702
2016/0056527 A1* 2/2016 Pascolini ..... H01Q 9/0485 343/702
2016/0064801 A1* 3/2016 Han ..... H01Q 9/42 343/702
2016/0064820 A1* 3/2016 Kim ..... H01Q 9/0421 343/767
2016/0079659 A1* 3/2016 Wang ..... H01Q 1/24 343/702
2016/0093955 A1* 3/2016 Ayala Vazquez ..... H01Q 5/335 343/702
2016/0202668 A1* 7/2016 Chen ..... G04G 17/08 368/10
2016/0308271 A1* 10/2016 Jin ..... H01Q 1/48
2016/0322699 A1* 11/2016 Mow ..... H01Q 13/10
2016/0336643 A1* 11/2016 Pascolini ..... H01Q 9/0421
2017/0033812 A1* 2/2017 Son ..... H01Q 5/371
2017/0142241 A1* 5/2017 Kim ..... H04M 1/0218
2017/0244818 A1* 8/2017 Kim ..... H01Q 1/243
2017/0256843 A1* 9/2017 Hu ..... H01Q 21/28
2017/0294706 A1* 10/2017 Koga ..... H04M 1/02
2017/0358847 A1* 12/2017 Cho ..... H05K 1/18
2018/0062245 A1* 3/2018 Wu ..... H01Q 1/273
2018/0123234 A1 5/2018 Wang et al.
2018/0278731 A1* 9/2018 Lee ..... H04B 1/3833
2021/0151886 A1* 5/2021 Wang ..... H01Q 21/28

FOREIGN PATENT DOCUMENTS

CN 105244599 A 1/2016
CN 105375109 A 3/2016
CN 106571516 A 4/2017

* cited by examiner

ANTENNA STRUCTURE AND WIRELESS COMMUNICATION DEVICE USING THE SAME

FIELD

The subject matter herein generally relates to an antenna structure and a wireless communication device using the antenna structure.

BACKGROUND

Wireless communication devices are lighter and thinner, and appearance of the wireless communication device is also important. A metal housing has a good appearance, mechanical strength, good heat dissipation, and other advantages. Wireless communication devices often have the metal housing, the metal housing being used as a metal backboard. However, the metal housing may interfere with signals radiated by an antenna positioned therein, and poor radiation performance of the antenna makes stable and reliable wideband performance problematic.

Therefore, there is room for improvement within the art.

BRIEF DESCRIPTION OF THE DRAWINGS

Implementations of the present technology will now be described, by way of example only, with reference to the attached figures.

DETAILED DESCRIPTION

Figure 1:
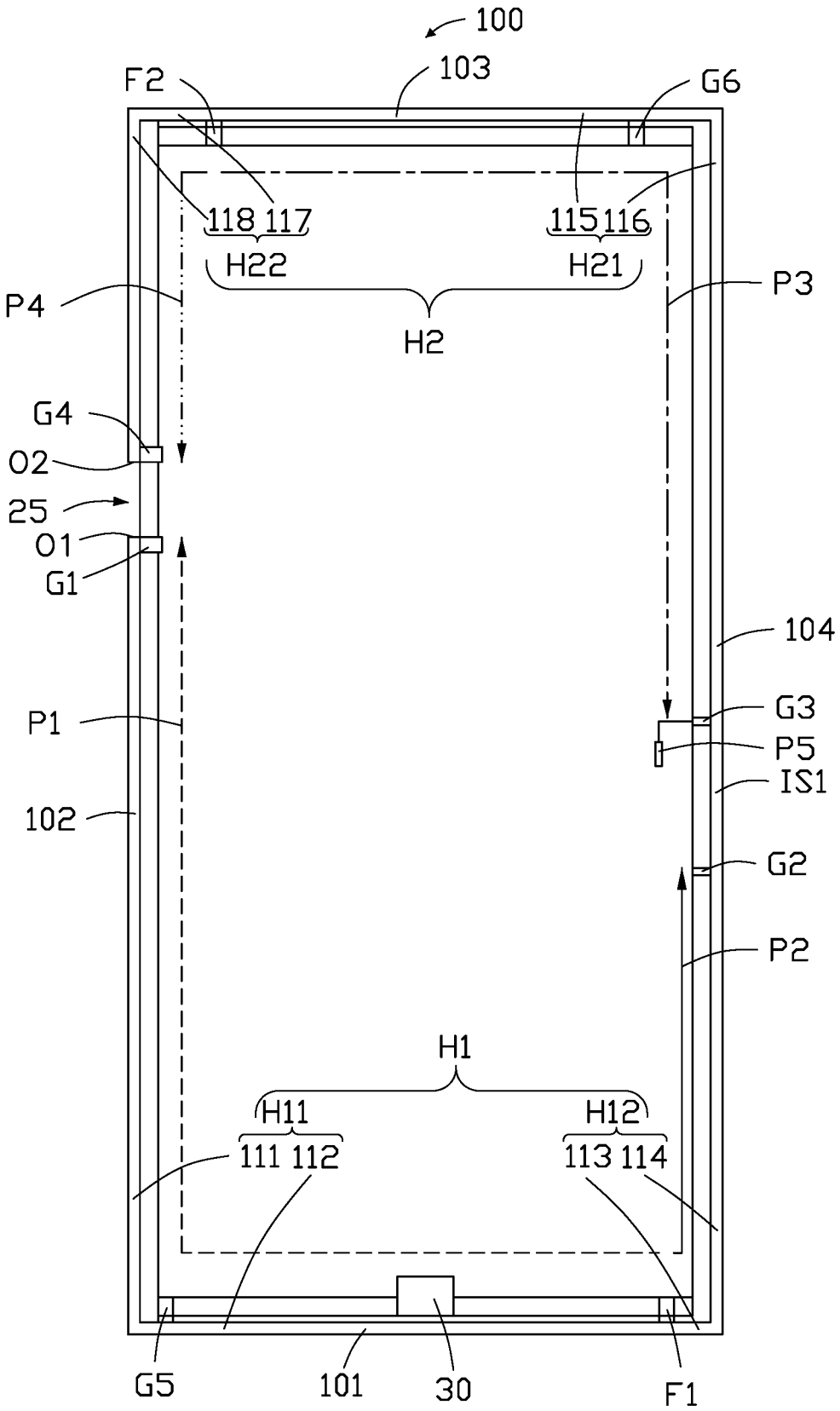
FIG. 1 is an isometric view of an embodiment of a wireless communication device using an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. It should be noted that references to "an" or "one" embodiment in this disclosure are not necessarily to the same embodiment, and such references mean "at least one."

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

Figure 2:
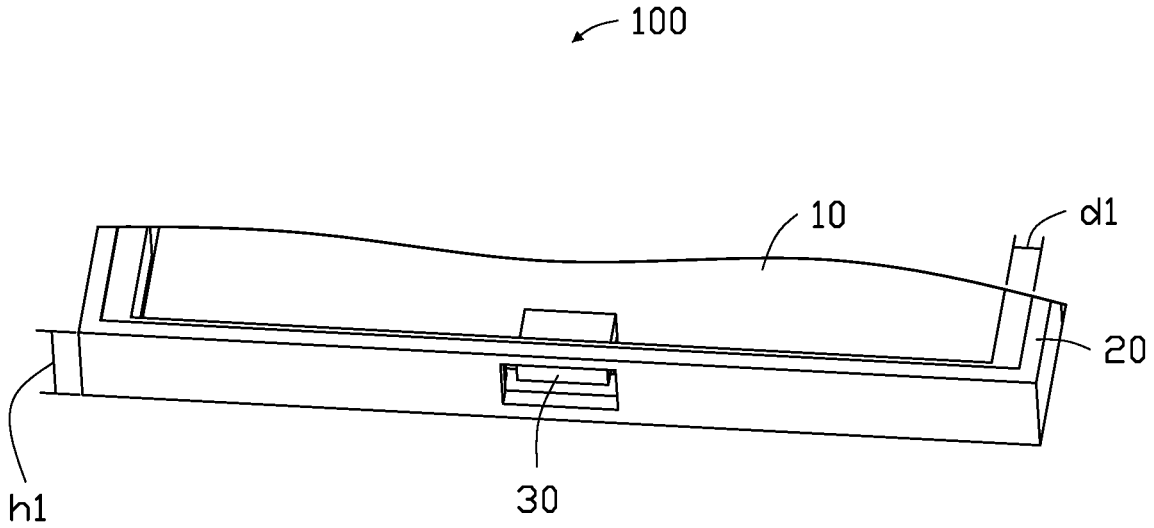
FIG. 2 is an isometric view of the antenna structure of FIG. 1.

FIG. 1 is an embodiment of an antenna structure 100. The antenna structure 100 can be applied in a wireless communication device (not shown). The antenna structure 100 is configured to transmit and receive wireless signals. The wireless communication device can be a mobile phone, a personal digital assistant, or an MP3 player. Referring to FIG. 2, the wireless communication device includes a motherboard 10 and the antenna structure 100.

Referring to FIG. 2, the antenna structure 100 including a metallic frame 20, a first feeding source F1, and a second feeding source F2. The metallic frame 20 is substantially frame-shaped. The metallic frame 20 is a metallic structure having a notch portion 25. The metallic frame 20 includes a first radiating portion H1 and a second radiating portion H2. The metallic frame 20 is disposed at a periphery of the motherboard 10. In this embodiment, a height h1 of the metallic frame 20 is about 7 mm. A gap dl between the metallic frame 20 and the motherboard 10 is about 2 mm. A USB component 30 is disposed at a middle portion at one of a shorter end of the motherboard 10. The USB component 30 allows charging and wired data transmission.

In one embodiment, a width of the notch portion 25 is about 25 mm. The notch portion 25 can receive a SIM card or an SD card, or house a power button, a volume button, or a headphone jack. The notch portion 25 can be made of plastic, ceramic, or other non-metallic and non-conductive material.

The first feeding source F1 is electrically connected to the first radiating portion H1. The first radiating portion H1 can operate in first and second modes simultaneously, to generate radiation signals respectively in a first frequency band and a second frequency band.

The second feeding source F2 is electrically connected to the second radiating portion H2. The second radiating portion H2 can operate in third and fourth modes simultaneously to generate radiation signals in a third frequency band and a fourth frequency band respectively.

In one embodiment, frequencies of the second frequency band are higher than frequencies of the first frequency band, and frequencies of the fourth frequency band are higher than frequencies of the third frequency band.

In one embodiment, the antenna structure 100 further includes a first grounding portion G1, a second grounding portion G2, a third grounding portion G3, and a fourth round portion G4. The first grounding portion G1, the second grounding portion G2, the third grounding portion G3, and the fourth round portion G4 are all electrically connected to the metallic frame 20 and provide ground connection for the antenna structure 100. The metallic frame 20 is divided into the first radiating portion H1, the second radiating portion H2, and an isolation portion IS1. Such division is an electronic division, being achieved by the particular connecting locations of the first grounding portion G1, the second grounding portion G2, the third grounding portion G3, and the fourth round portion G4.

The notch portion 25 is located between the first grounding portion G1 and the fourth grounding portion G4. The isolation portion IS1 is located between the second grounding portion G2 and the third grounding portion G3. The first radiating portion H1, the first feeding source F1, the first grounding portion G1, and the second grounding portion G2 form a first antenna. The second radiating portion H2, the second feeding source F2, the first grounding portion G1, and the third grounding portion G3 form a secondary antenna. In one embodiment, the first antenna is a main antenna. The secondary antenna is a diversity antenna or a secondary antenna.

The isolation portion IS1 is located between the first radiating portion H1 and the second radiating portion H2 to increase an isolation between the first antenna and the secondary antenna.

In one embodiment, the metallic frame 20 can be rectangular. The metallic frame 20 includes a first endpoint O1, a second endpoint O2, a first side edge 101, a second side edge 102, a third side edge 103, and a fourth side edge 104. The first side edge 101 defines an opening (not shown) to expose the USB component 30. FIG. 2 shows that, the first endpoint O1 and the second endpoint O2 are positioned on the second side edge 102. The notch portion 25 is formed between the first endpoint O1 and the second endpoint O2.

The first feeding source F1 is electrically connected to the first side edge 101. A node between the first feeding source F1 and the first side edge 101 is located near the fourth side edge 104. The second feeding source F2 is electrically connected to the third side edge 103. A node between the second feeding source F2 and the third side edge 103 is located near the second side edge 102. The first grounding portion G1 is electrically connected to the first endpoint O1. The second grounding portion G2 is electrically connected to the fourth side edge 104. A node between the second grounding portion G2 and the fourth side edge 104 is located near the first side edge 101. The third grounding portion G3 is electrically connected to a matching component P5 and the fourth side edge 104. A node between the third grounding portion G3 and the fourth side edge 104 is located near the third side edge 103. The fourth grounding portion G4 is electrically connected to the second endpoint O2.

A first end of the matching components P5 is electrically connected to the third grounding portion G3. A second end of the matching components P5 is grounded. The matching components P5 can be an inductor, a capacitor, or a resistor. The matching component P5 is configured to match an impedance of the second radiating portion H2.

A portion of the metallic frame 20 from the first feeding source F1 to the first grounding portion G1 forms a first branch H11. A portion of the metallic frame 20 from the first feeding source F1 to the second grounding portion G2 forms a second branch H12. The first branch H11 is configured to activate the first mode and the second branch H12 is configured to activate the second mode.

A portion of the metallic frame 20 from the second feeding source F2 to the third grounding portion G3 forms a third branch H21. A portion of the metallic frame 20 from the second feeding source F2 to the fourth grounding portion G4 forms a fourth branch H22. The third branch H21 is configured to activate the third mode and the fourth branch H22 is configured to activate the fourth mode.

In one embodiment, the first feeding source F1, the first branch H11, and the first grounding portion G1 are in shape of inverted F, and such antenna can be activated in the first mode to generate radiation signals in the first frequency band. The first feeding source F1, the second branch H12, and the second grounding portion G2 are in shape of inverted F, and such antenna can be activated in the second mode to generate radiation signals in the second frequency band.

In one embodiment, the first mode can be long term evolution advanced (LTE-A) low and middle frequency modes. The second mode can be a LTE-A high frequency mode. In one embodiment, frequencies of the second frequency band are higher than frequencies of the first frequency band. The first frequency band includes frequency bands of 700-960 MHz and 1710-2300 MHz. The second frequency band includes frequency bands of 2300-2690 MHz.

The second feeding source F2, the third branch H21, and the third grounding portion G3 are in shape of inverted F, and such antenna can be activated in the third mode to generate radiation signals in the third frequency band. The second feeding source F2, the fourth branch H22, and the fourth grounding portion G4 are in shape of inverted F, and such antenna can be activated in the fourth mode to generate radiation signals in the fourth frequency band.

In one embodiment, the third mode can be an LTE-A low frequency mode. The fourth mode can be a LTE-A middle and high frequency modes of the LTE-A.

In one embodiment, frequencies of the fourth frequency band are higher than frequencies of the third frequency band. The third frequency band includes frequency bands of 734-960 MHz. The fourth frequency band includes frequency bands of 1800-2170 MHz and 2300-2690 MHz.

In one embodiment, the secondary antenna can work at a frequency band which includes global positioning system (GPS) frequency. The secondary antenna can be configured to receive GPS signals. The antenna structure 100 can add a duplexer or a signal extractor to extract the GPS signals from wireless signals received by the secondary antenna.

In one embodiment, the first branch H11 includes a first radiating arm 111 and a second radiating arm 112. The first radiating arm 111 and the second radiating arm 112 are substantially rectangular. A first end of the first radiating arm 111 is perpendicularly connected to a first end of the second radiating arm 112. The first feeding source F1 is electrically connected to a second end of the first radiating arm 111. The first grounding portion G1 is electrically connected to a second end of the second radiating arm 112.

The second branch H12 includes a third radiating arm 113 and a fourth sub radiating arm 114. The third radiating arm 113 and the fourth sub radiating arm 114 are substantially rectangular. A first end of the third radiating arm 113 is electrically connected to a first end of the fourth sub radiating arm 114 in a perpendicular direction. The first feeding source F1 is electrically connected to a second end of the third radiating arm 113. The second grounding portion G2 is electrically connected to a second end of the fourth sub radiating arm 114.

In one embodiment, the third branch H21 includes a fifth sub radiating arm 115 and a sixth sub radiating arm 116. The fifth sub radiating arm 115 and the sixth sub radiating arm 116 are substantially rectangular. A first end of the fifth sub radiating arm 115 is electrically connected to a first end of the sixth sub radiating arm 116 in a perpendicular direction. The second feeding source F2 is electrically connected to a second end of the fifth sub radiating arm 115. The third grounding portion G3 is electrically connected to a second end of the sixth sub radiating arm 116.

The fourth branch H22 includes a seventh sub radiating arm 117 and an eighth sub radiating arm 118. The seventh sub radiating arm 117 and the eighth sub radiating arm 118 are substantially rectangular. A first end of the seventh sub radiating arm 117 is electrically connected to a first end of the eighth sub radiating arm 118 in a perpendicular direction. The second feeding source F2 is electrically connected to a second end of the seventh sub radiating arm 117, and the fourth grounding portion G4 is electrically connected to a second end of the eighth sub radiating arm 118.

Figure 3:
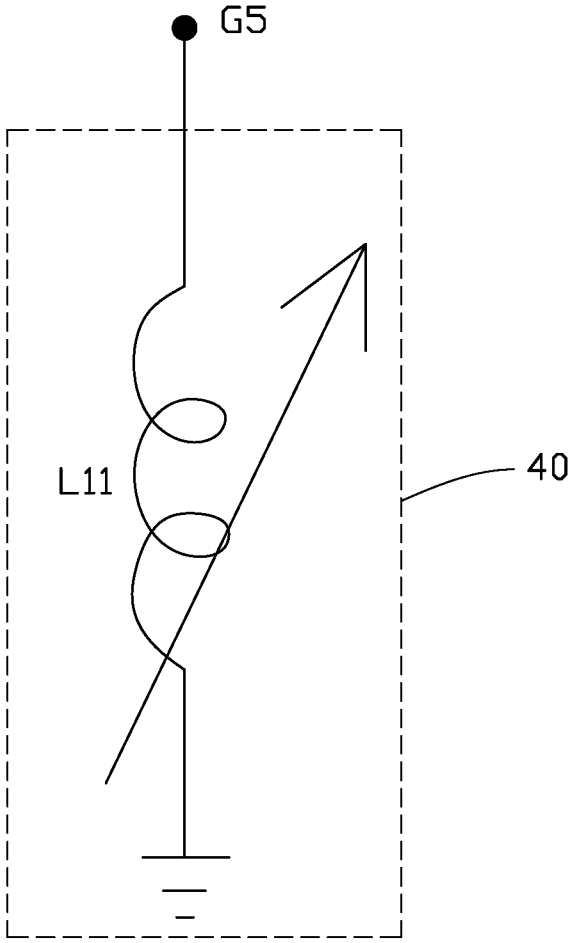
FIG. 3 is similar to FIG. 1, but shown from another angle.

FIG. 1 and FIG. 3 show that, to render the first radiating portion H1 operable in a preferred low frequency band, the antenna structure 100 further includes a fifth grounding portion G5 and a first switch circuit 40. The first switch circuit 40 is positioned on the motherboard 10. The first switch circuit 40 includes a first adjustable inductor L11. The fifth grounding portion G5 is electrically connected between the first radiating arm 111 of the first branch H11 and the first adjustable inductor L11. A first end of the first adjustable inductor L11 is electrically connected to the fifth grounding portion G5. A second end of the first adjustable inductor L11 is grounded. When an inductance of the first adjustable inductor L11 is changed, the first frequency band of the first radiating portion H1 is changed.

Figure 4:
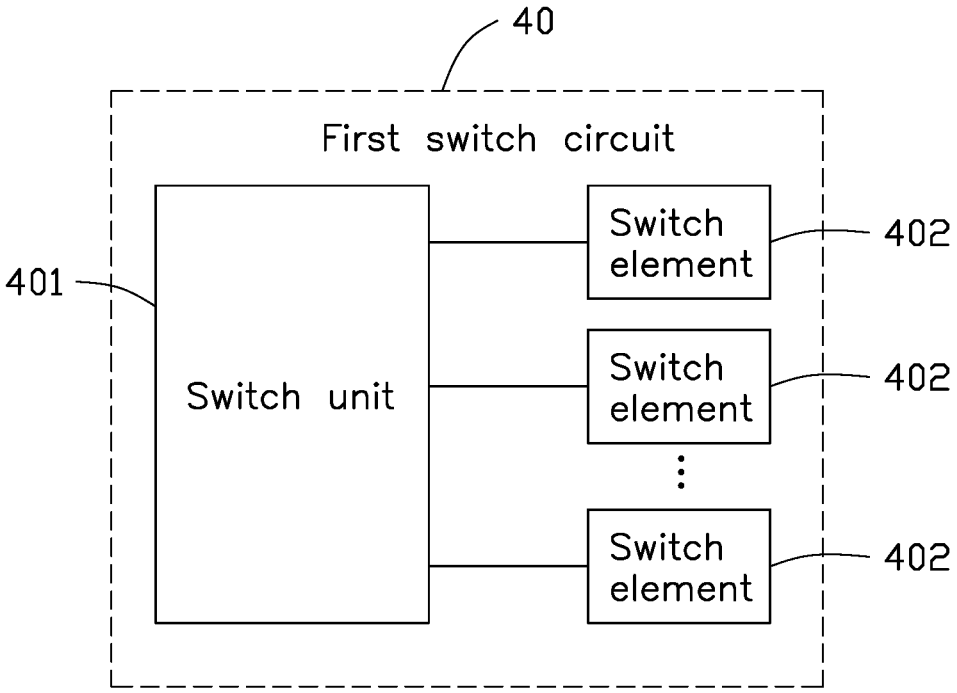
FIG. 4 is a circuit diagram of the antenna structure of FIG. 1.
Figure 5:
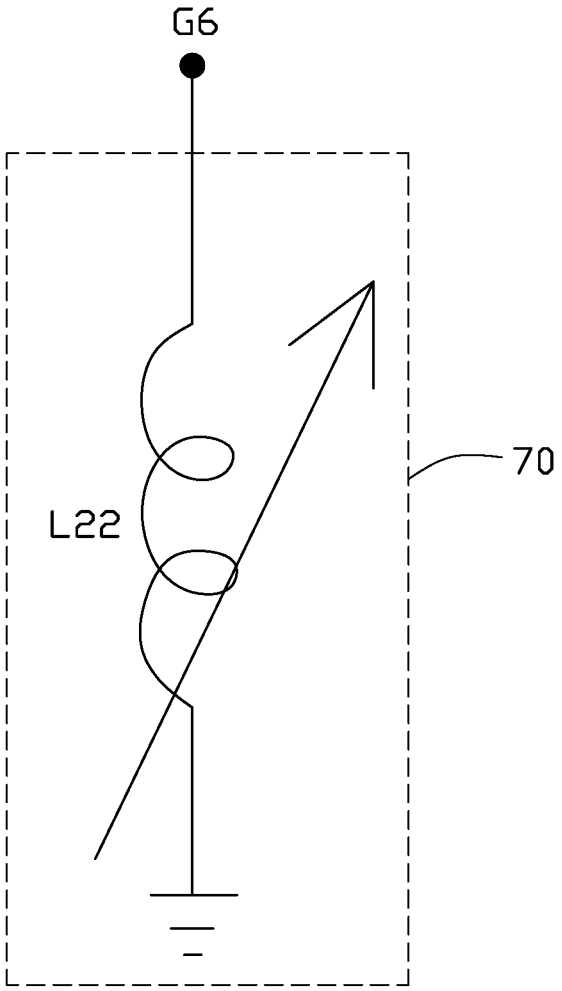
FIG. 5 is a current flow diagram of the antenna structure of FIG. 1.

FIG. 4 shows that, the first switch circuit 40 includes a switch unit 401 and a plurality of switch elements 402. The switch unit 401 is electrically connected to the fifth grounding portion G5. The switch elements 402 can be inductors, capacitors, or a combination of the inductors and the capacitors. The switch elements 402 are connected in parallel with each other. A first end of each switch element 402 is electrically connected to the switch unit 401. A second end of each of the switch elements 402 is grounded. The switch unit 401 can switch the first radiating arm 111 of the first branch H11 to connect to different switch elements 402.

In one embodiment, different switch elements 402 include different impedances. When different switch elements 402 are switched to connect to the first radiating arm 111, the low frequency band of the first radiating portion H1 can be changed. For example, the switch elements 402 includes five inductors. Respective inductances of the five switch elements 402 are 5 nH, 10 nH, 30 nH, 60 nH, and 90 nH.

In one embodiment, to render the first radiating portion H2 operable in a preferred low frequency band, the antenna structure 100 further includes a sixth grounding portion G6 and a second switch circuit 70. The second switch circuit 70 is positioned on the motherboard 10. The second switch circuit 70 includes a second adjustable inductor L22. The sixth grounding portion G6 is electrically connected between the fifth sub radiating arm 115 of the third branch H21 and the second adjustable inductor L22. A first end of the second adjustable inductor L22 is electrically connected to the sixth grounding portion G6. A second end of the second adjustable inductor L22 is grounded.

When an inductance of the second adjustable inductor L22 is changed, the first frequency band of the second radiating portion H2 is changed. The second switch circuit 70 also includes a switch unit 401 and a plurality of switch elements 402.

FIG. 1 show that, when a current flows from the first feeding source F1, a part of the current flows through the first branch H11 of the first radiating portion H1 to activate the antenna in the first mode (per path P1). Another part of the current flows through the second branch H12 of the first radiating portion H1 to activate the antenna in the second mode (per path P2).

When a current flows from the second feeding source F2, a part flows through the third branch H21 of the second radiating portion H2 grounding portion to activate the antenna in the third mode (per path P3). Another part of the current flows through the fourth branch H22 of the second radiating portion H2 grounding portion to activate the antenna in the fourth mode (per path P4).

Figure 6:
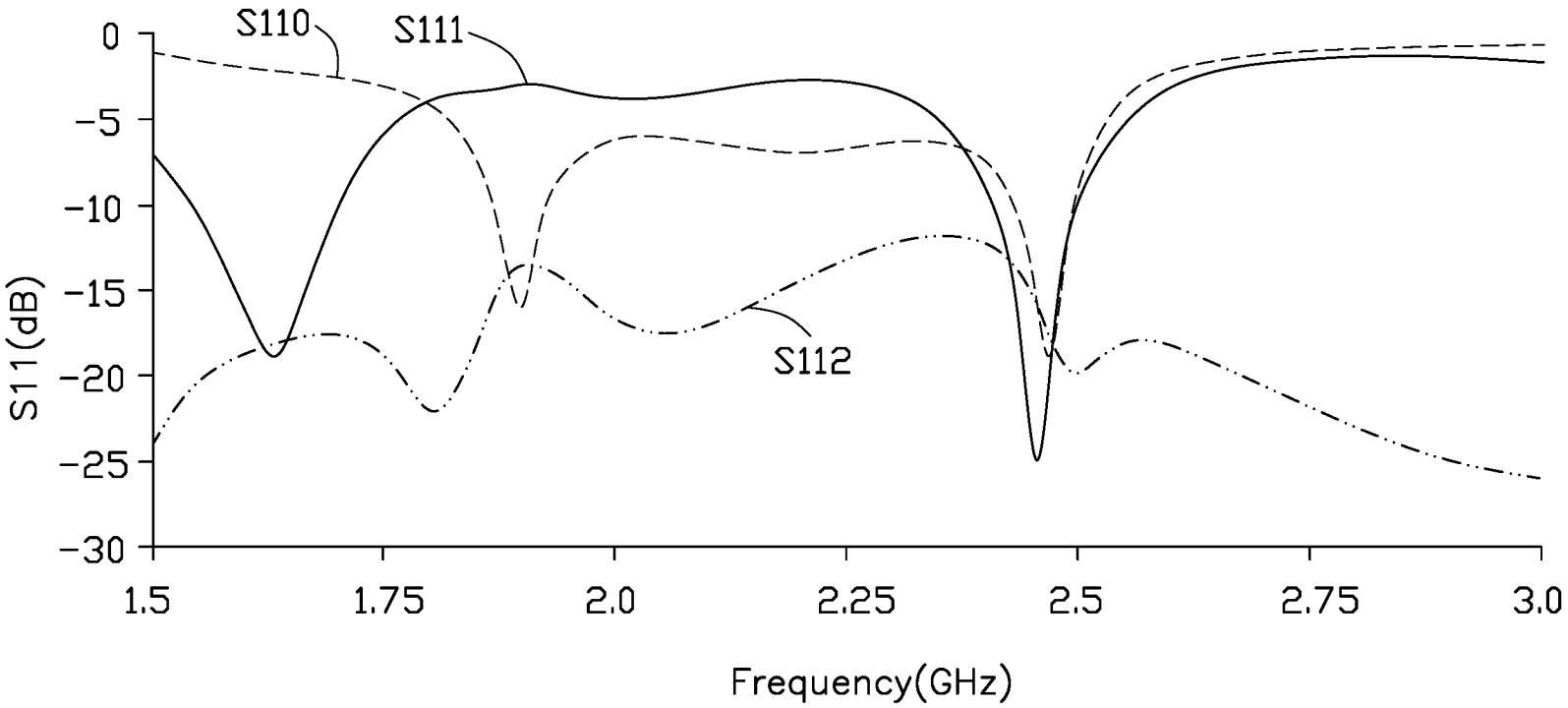
FIG. 6 is a graph showing scattering when a main antenna working in low and middle frequency operating modes.

FIG. 6 shows scattering when the first antenna working in a LTE-A middle and high frequency modes. Curve S110 shows the scattering when the first antenna working in the LTE-A middle and high frequency modes. Curve S111 shows the scattering of the secondary antenna when the secondary antenna working in LTE-A middle and high frequency modes. Curve S112 shows the scattering of first and secondary antennas when the first and secondary antennas working in the LTE-A middle and high frequency modes. The isolation between the first and secondary antennas is above 10 dB.

Figure 7:
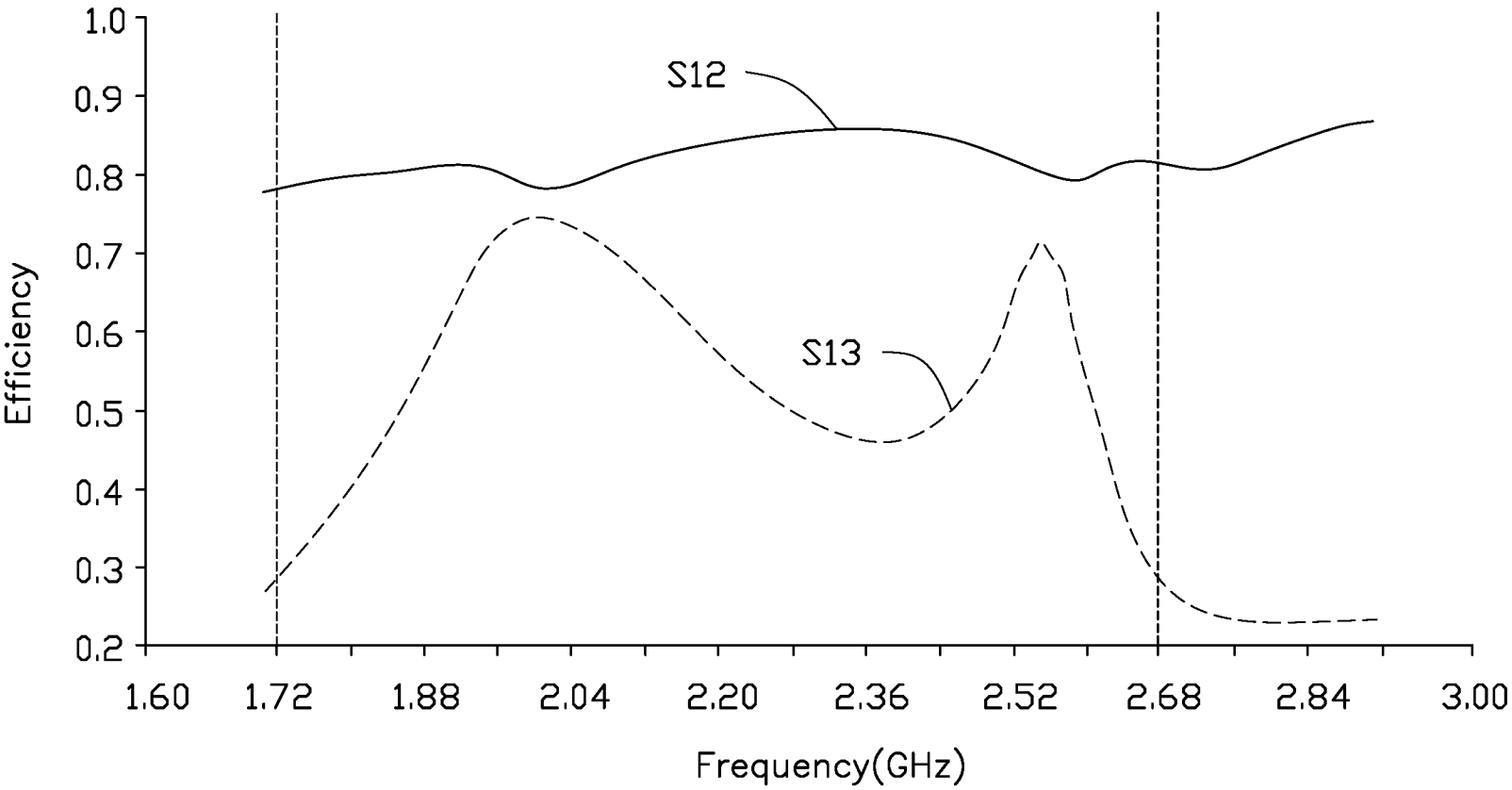
FIG. 7 shows scattering when the antenna structure working in a high frequency operating mode.

FIG. 7 shows total radiation efficiency of the antenna structure 100 in the LTE-A middle and high frequency modes. Curve S12 shows a radiation efficiency of the first antenna when working in the LTE-A middle and high frequency modes. Curve S13 shows a total radiation efficiency of the first antenna when working in the LTE-A middle and high frequency modes. An average total efficiency of the first antenna at the high frequency mode is about −3 dB.

Figure 8:
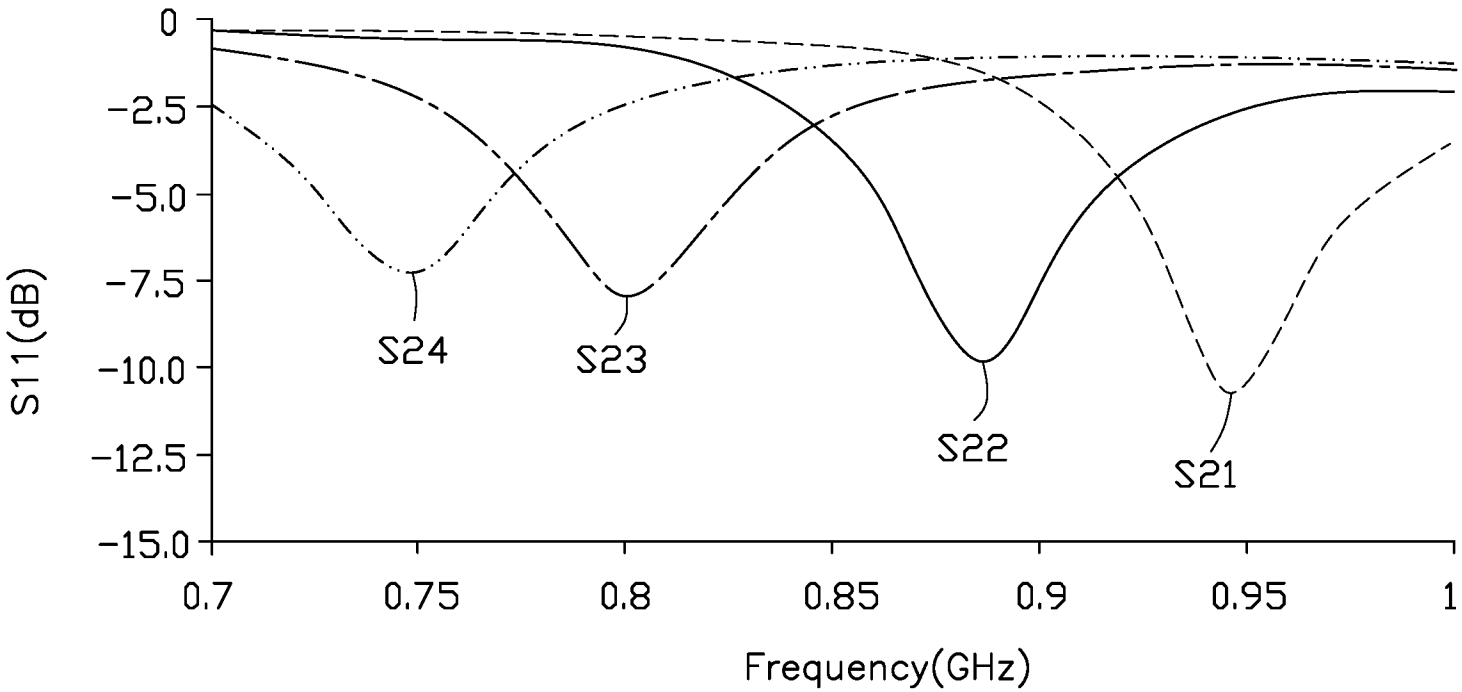
FIG. 8 shows scattering when a main antenna working in a low frequency operating mode.

FIG. 8 shows a scattering parameter of the antenna structure 100 when the first antenna working in the LTE-A low frequency mode. When the first switch circuit 40 controls the switch unit 401 to switch different switch elements 402 (inductances of the switch elements 402 are 5 nH, 10 nH, 30 nH, and 90 nH), the low frequency band of the first antenna can be changed. Curve S21 shows a scattering parameter of the first antenna of the antenna structure 100 when an inductance value of the switch element 402 is 5 nH and the first antenna working in the LTE-A low frequency mode. Curve S22 shows a scattering parameter of the first antenna of the antenna structure 100 when the inductance value of the switch element 402 is 10 nH and the first antenna working in the LTE-A low frequency mode. Curve S23 shows a scattering parameter of the first antenna of the antenna structure 100 when the inductance value of the switch element 402 is 30 nH and the first antenna working in the LTE-A low frequency mode. Curve S24 shows a scattering parameter of the first antenna of the antenna structure 100 when the inductance value of the switch element 402 is 90 nH and the first antenna working in the LTE-A low frequency mode.

Figure 9:
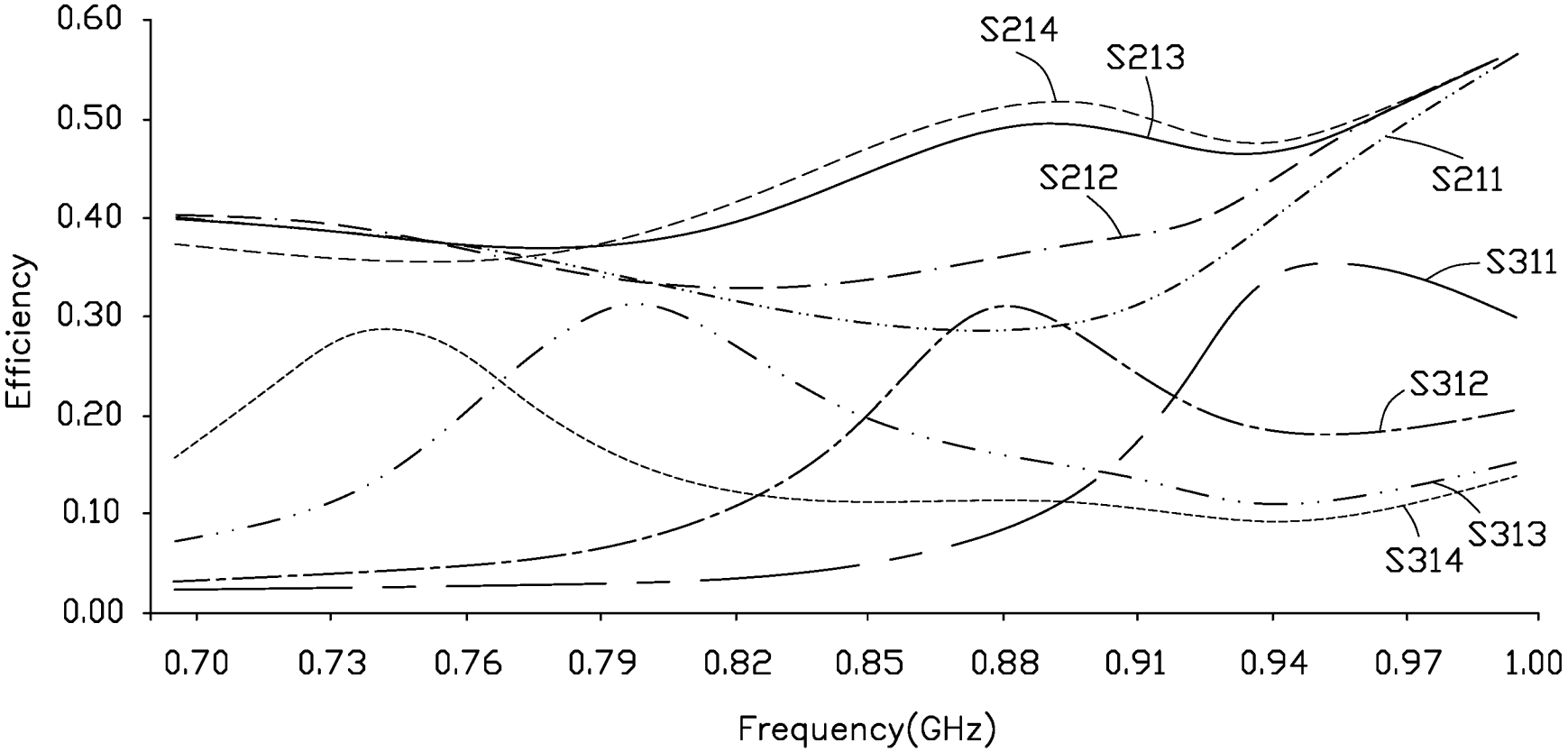
FIG. 9 is a graph showing total radiation efficiency when the antenna structure working in the low frequency operating mode.

FIG. 9 shows a total radiation efficiency graph of the antenna structure 100 when the antenna structure 100 working in the LTE-A low frequency mode. Curve S211 shows a radiation efficiency of the antenna structure 100 when an inductance value of the switch element 402 is 5 nH and the first antenna working in the LTE-A low frequency mode. Curve S212 shows a radiation efficiency of the antenna structure 100 when an inductance value of the switch element 402 is 10 nH and the first antenna working in the LTE-A low frequency mode. Curve S213 shows a radiation efficiency of the antenna structure 100 when an inductance value of the switch element 402 is 30 nH and the first antenna working in the LTE-A low frequency mode. Curve S214 shows a radiation efficiency of the antenna structure 100 when an inductance value of the switch element 402 is 90 nH and the first antenna working in the LTE-A low frequency mode.

Curve S311 shows a total radiation efficiency of the antenna structure 100 when an inductance value of the switch element 402 is 5 nH and the first antenna working in the LTE-A low frequency mode. Curve S312 shows a total radiation efficiency of the antenna structure 100 when an inductance value of the switch element 402 is 10 nH and the first antenna working in the LTE-A low frequency mode. Curve S313 shows a total radiation efficiency of the antenna structure 100 when an inductance value of the switch element 402 is 30 nH and the first antenna working in the LTE-A low frequency mode. Curve S314 is a total radiation efficiency of the antenna structure 100 when an inductance value of the switch element 402 is 90 nH and the first antenna working in the LTE-A low frequency mode. The average total efficiency of the first antenna when the first antenna working in the LTE-A low frequency mode is about −5.2-6 dB.

Figure 10:
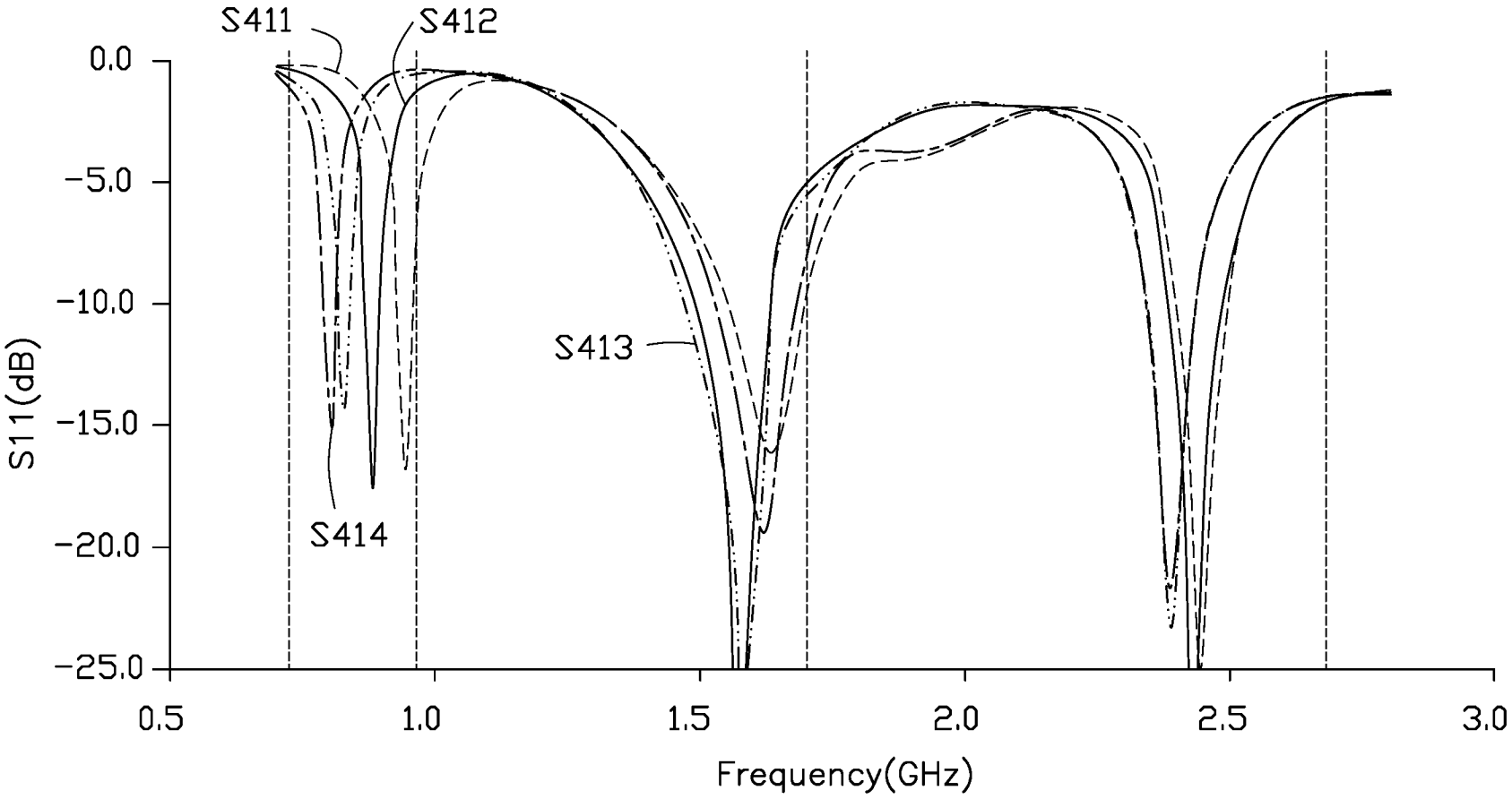
FIG. 10 shows scattering when a secondary antenna working in middle and high frequency operating modes and GPS (Global Positioning System) operating mode.

FIG. 10 shows a scattering parameter graph of the antenna structure 100 when the secondary antenna working in the LTE-A low, middle and high frequency modes and in a GPS mode. When the first switch circuit 40 controls the switch unit 401 to switch different switch elements 402 (inductances of the switch elements 402 are 20 nH, 35 nH, 60 nH, and 100 nH), the low frequency band of the secondary antenna can be changed. Curves S411, S412, S413, and S414 show scattering parameter of the secondary antenna of the antenna structure 100 when the switch elements 402 switched to the inductance values 20 nH, 35 nH, 60 nH, and 100 nH and the secondary antenna working in the LTE-A low, middle, and high frequency modes and in a GPS mode.

Figure 11:
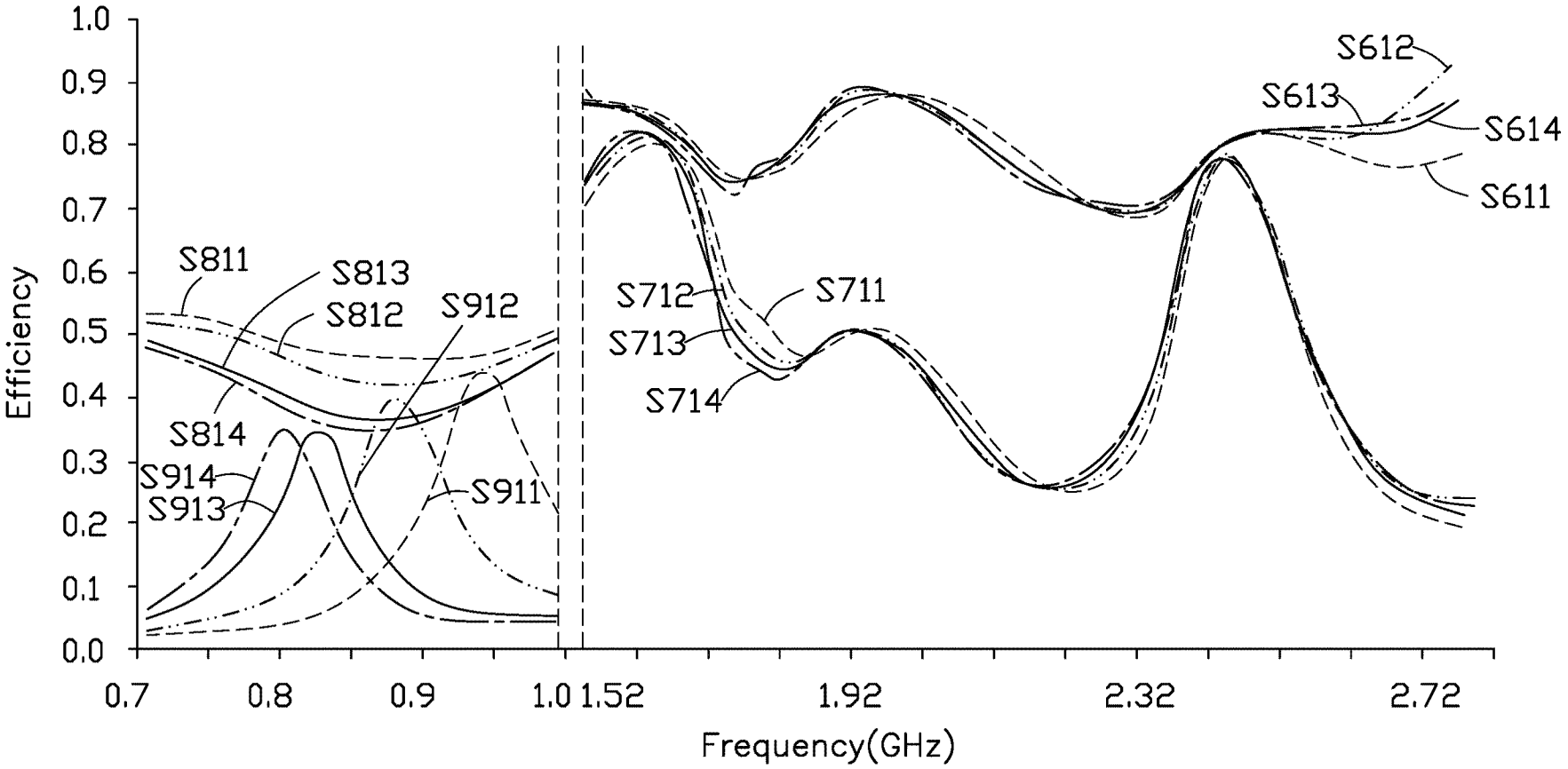
FIG. 11 shows total radiation efficiency when a secondary antenna working in the middle and high frequency operating modes and the GPS operating mode.

FIG. 11 shows a total radiation efficiency graph of the antenna structure 100 when the antenna structure 100 working in the LTE-A low, middle and high frequency modes and in a GPS mode. Curves S611, S612, S613, and S614 show a radiation efficiency of the antenna structure 100 when the switch elements 402 are switched to the inductance values 20 nH, 35 nH, 60 nH, and 100 nH and the secondary antenna working in the LTE-A middle and high frequency mode and a GPS mode. Curves S711, S712, S713, and S714 show a total radiation efficiency of the antenna structure 100 when the switch elements 402 are switched to the inductance values 20 nH, 35 nH, 60 nH, and 100 nH and the secondary antenna working in the LTE-A middle and high frequency modes and a GPS mode. Curves S811, S812, S813, and S814 show a radiation efficiency of the antenna structure 100 when the switch elements 402 are switched to the inductance values 20 nH, 35 nH, 60 nH, and 100 nH and the secondary antenna working in the LTE-A low frequency mode. Curves S911, S912, S913, and S914 show a total radiation efficiency of the antenna structure 100 when the switch elements 402 are switched to the inductance values 20 nH, 35 nH, 60 nH, and 100 nH and the secondary antenna working in the LTE-A low frequency mode. An average total efficiency of the secondary antenna when the secondary antenna working in the LTE-A low frequency mode is about −4.5-5.5 dB. An average total efficiency of the secondary antenna when the secondary antenna working in the LTE-A high frequency mode is about −3.4 dB. An average total efficiency of the secondary antenna when the secondary antenna working in the GPS mode is about −1 dB.

Figure 12:
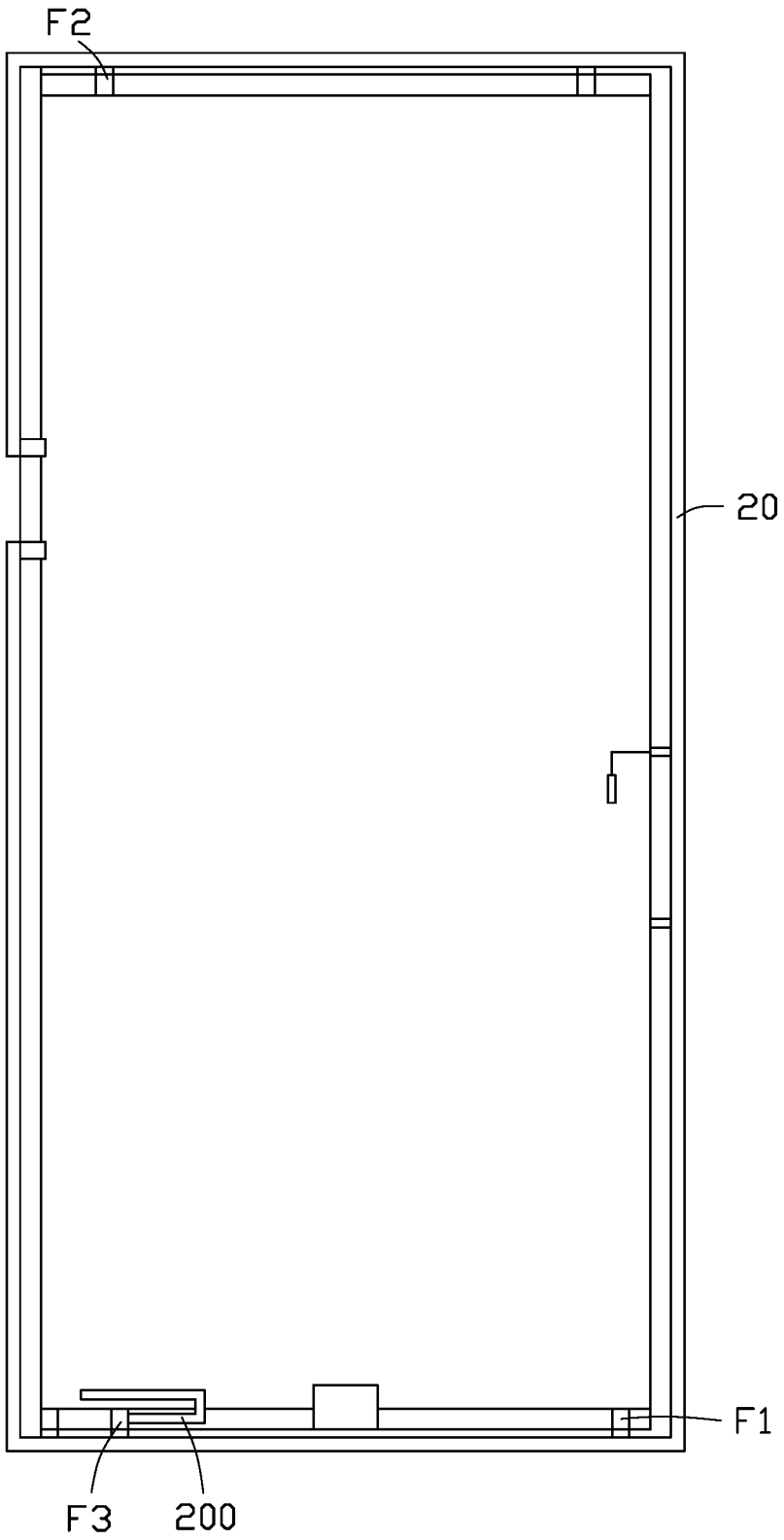
FIG. 12 is an isometric view of another embodiment of an antenna structure.

In another embodiment, FIG. 12 shows the antenna structure 100 including a third feeding source F3. The third feeding source F3 is configured to form a third antenna 200. The third feeding source F3 can be, for example, a loop antenna, a Planar Inverted-F Antenna (PIFA) antenna, a slot antenna, or a hybrid antenna including multiple types of antenna structures. The length of the third antenna 200 is about 35 mm.

Figure 13:
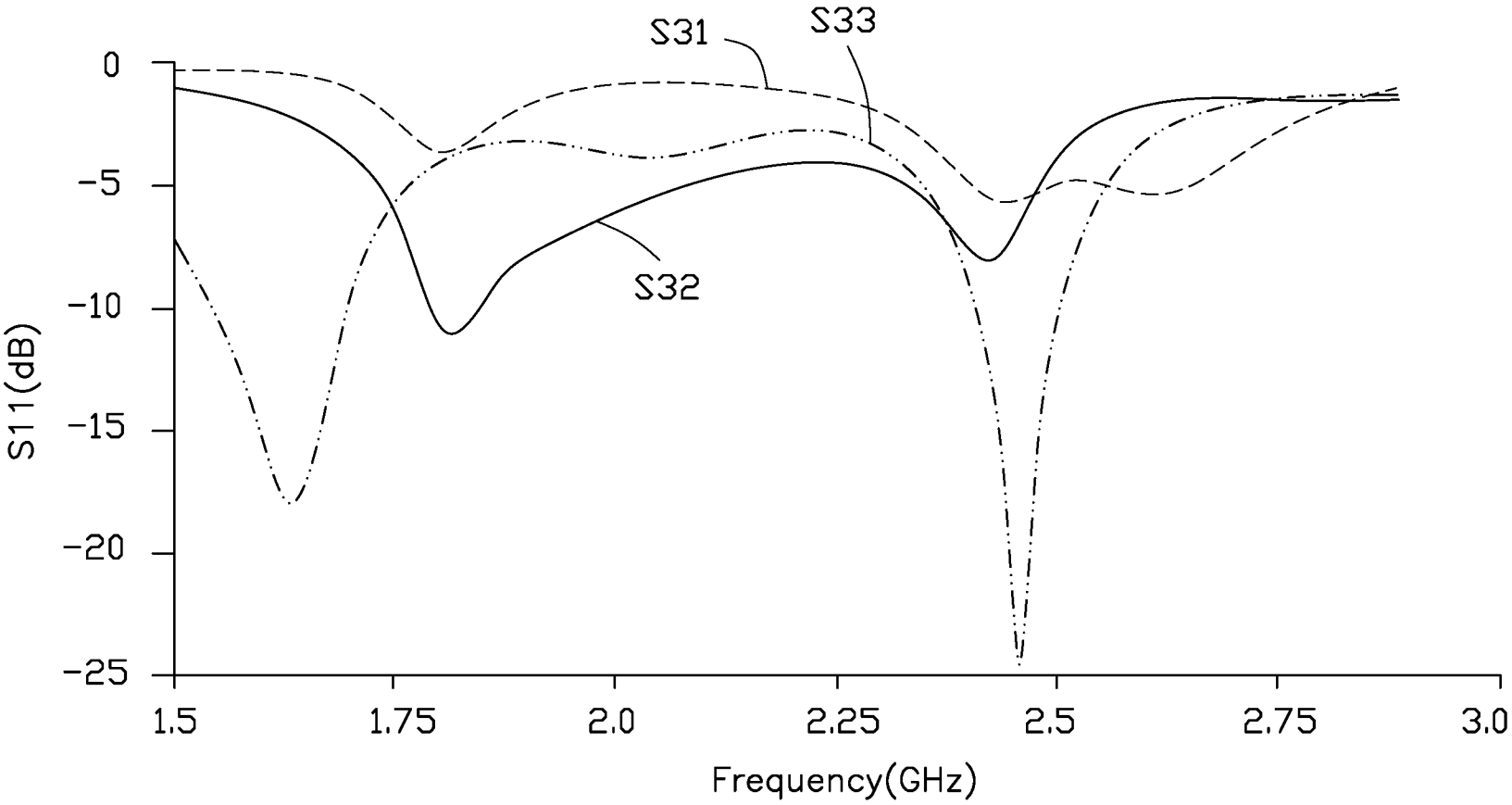
FIG. 13 shows scattering when the antenna structure of FIG. 12 working in middle and high frequency operating modes.

FIG. 13 shows a scattering parameter graph of the antenna structure 100 when the secondary antenna working in the LTE-A middle and high frequency modes. Curve S31 shows a scattering parameter of the first antenna of the antenna structure 100 when the first antenna working in the LTE-A high frequency mode. Curve S32 shows a scattering parameter of the first antenna of the antenna structure 100 when the first antenna working in the LTE-A middle frequency mode. Curve S33 shows a scattering parameter of the first antenna of the antenna structure 100 when the secondary antenna working in the LTE-A middle and high frequency mode.

The notch portion 25 is positioned on the metallic frame 20 of the antenna structure 100, and divides the metallic frame 20 into the first radiating portion H1 and the second radiating portion H2. First and second modes can be activated simultaneously in the first radiating portion H1 to generate radiation signals in the LTE-A low, medium, and high frequency bands. Third and fourth modes can be activated simultaneously in the second radiating portion H2 to generate radiation signals in the LTE-A low, medium, and high frequency bands. The wireless communication device can use the Carrier Aggregation (CA) technology of LTE-A and use the first radiating portion H1 or the second radiating portion H2 to simultaneously receive and send wireless signals at multiple different frequency bands to increase transmission bandwidth, for example, to achieve 3CA.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a metallic frame comprising a first radiating portion, a second radiating portion, and a notch portion;

a first feeding source electrically connected to the first radiating portion for feeding current to the first radiating portion;

a second feeding source electrically connected to the second radiating portion for feeding current to the second radiating portion;

a first grounding portion;

a second grounding portion;

a third grounding portion; and a fourth grounding portion;

wherein notch portion is defined between the first radiating portion and the second radiating portion, the first grounding portion and the second grounding portion are electrically connected to opposite ends of the first radiating portion, the third grounding portion and the fourth grounding portion are electrically connected to opposite ends of the second radiating portion, the notch portion is located between the first grounding portion and the fourth grounding portion;

wherein the first radiating portion operates in first and second modes simultaneously, to generate radiation signals in a first frequency band and a second frequency band respectively; and the second radiating portion operates in third and fourth modes simultaneously, to generate radiation signals in a third frequency band and a fourth frequency band respectively; and wherein frequencies of the second frequency band are higher than frequencies of the first frequency band, and frequencies of the fourth frequency band are higher than frequencies of the third frequency band.

2. The antenna structure of claim 1, wherein the first grounding portion, the second grounding portion, the third grounding portion, and the fourth grounding portion are electrically connected between the metallic frame and a grounding plane, wherein the metallic frame is divided into the first radiating portion, the second radiating portion, and an isolation portion, such division is an electronic division, being achieved by the connecting locations of the first grounding portion, the second grounding portion, the third grounding portion, and the fourth grounding portion; and wherein the isolation portion is located between the first radiating portion and the second radiating portion.

3. The antenna structure of claim 2, further comprising a matching component configured to match an impedance of the second radiating portion, wherein a first end of the matching component is electrically connected to the third grounding portion, and a second end of the matching component is grounded.

4. The antenna structure of claim 3, wherein the matching component is a capacitor, an inductor, or a resistor.

5. The antenna structure of claim 2, wherein a portion of the metallic frame from the first feeding source to the first grounding portion forms a first branch, and a portion of the metallic frame from the first feeding source to the second grounding portion forms a second branch;

wherein the first branch is configured to activate the first mode, and the second branch is configured to activate the second mode;

wherein a portion of the metallic frame from the second feeding source to the third grounding portion forms a third branch, and a portion of the metallic frame from the second feeding source to the fourth grounding portion forms a fourth branch; and wherein the third branch is configured to activate the third mode, and the fourth branch is configured to activate the fourth mode.

6. The antenna structure of claim 2, wherein the metallic frame is frame-shaped, the isolation portion is located between the second grounding portion and the third grounding portion.

7. The antenna structure of claim 5, further comprising a fifth grounding portion and a first switch circuit, the first switch circuit comprises a first adjustable inductor, a first end of the first adjustable inductor is electrically connected to the first branch through the fifth grounding portion, and a second end of the first adjustable inductor is grounded; wherein the first frequency band is changed in response to an inductance of the first adjustable inductor being changed.

8. The antenna structure of claim 5, further comprising a sixth grounding portion and a second switch circuit, the second switch circuit comprises a second adjustable inductor, a first end of the second adjustable inductor is electrically connected to the first branch through the sixth grounding portion, a second end of the second adjustable inductor is grounded; wherein the third frequency band is changed in response to an inductance of the second adjustable inductor being changed.

9. The antenna structure of claim 6, wherein the notch portion is made of a non-conductive material.

10. A wireless communication device comprising a motherboard, and an antenna structure, wherein the antenna structure comprises:

a metallic frame comprising a first radiating portion, a second radiating portion, and a notch portion;

a first feeding source electrically connected to the first radiating portion for feeding current to the first radiating portion;

a second feeding source electrically connected to the second radiating portion for feeding current to the second radiating portion;

a first grounding portion;

a second grounding portion;

a third grounding portion; and a fourth grounding portion;

wherein notch portion is defined between the first radiating portion and the second radiating portion, the first grounding portion and the second grounding portion are electrically connected to opposite ends of the first radiating portion, the third grounding portion and the fourth grounding portion are electrically connected to opposite ends of the second radiating portion, the notch portion is located between the first grounding portion and the fourth grounding portion;

wherein the first radiating portion operates in first and second modes simultaneously, to generate radiation signals in a first frequency band and a second frequency band respectively; the second radiating portion operates in third and fourth modes simultaneously, to generate radiation signals in a third frequency band and a fourth frequency band respectively; and wherein frequencies of the second frequency band are higher than frequencies of the first frequency band, and frequencies of the fourth frequency band are higher than frequencies of the third frequency band.

11. The wireless communication device of claim 10, wherein the first grounding portion, the second grounding portion, the third grounding portion, and the fourth grounding portion are electrically connected between the metallic frame and a grounding plane, wherein the metallic frame is divided into the first radiating portion, the second radiating portion, and an isolation portion, such division is an electronic division, and being achieved by the particular connecting locations of the first grounding portion, the second grounding portion, the third grounding portion, and the fourth grounding portion; and wherein the isolation portion is located between the first radiating portion and the second radiating portion.

12. The wireless communication device of claim 11, further comprising a matching component configured to match an impedance of the second radiating portion, wherein a first end of the matching component is electrically connected to the third grounding portion, a second end of the matching component is grounded.

13. The wireless communication device of claim 12, wherein the matching component is a capacitor, an inductor, or a resistor.

14. The wireless communication device of claim 11, wherein a portion of the metallic frame from the first feeding source to the first grounding portion forms a first branch, and a portion of the metallic frame from the first feeding source to the second grounding portion forms a second branch;

wherein the first branch is configured to activate the first mode, and the second branch is configured to activate the second mode;

wherein a portion of the metallic frame from the second feeding source to the third grounding portion forms a third branch, and a portion of the metallic frame from the second feeding source to the fourth grounding portion forms a fourth branch; and wherein the third branch is configured to activate the third mode, and the fourth branch is configured to activate the fourth mode.

15. The wireless communication device of claim 11, wherein the metallic frame is frame-shaped, the isolation portion is located between the second grounding portion and the third grounding portion.

16. The wireless communication device of claim 14, further comprising a fifth grounding portion and a first switch circuit, the first switch circuit comprises a first adjustable inductor, a first end of the first adjustable inductor is electrically connected to the first branch through the fifth grounding portion, a second end of the first adjustable inductor is grounded; wherein the first frequency band is changed in response to an inductance of the first adjustable inductor being changed.

17. The wireless communication device of claim 14, further comprising a sixth grounding portion and a second switch circuit, the second switch circuit comprises a second adjustable inductor, a first end of the second adjustable inductor is electrically connected to the first branch through the sixth grounding portion, a second end of the second adjustable inductor is grounded; wherein the third frequency band is changed in response to an inductance of the second adjustable inductor being changed.

18. The wireless communication device of claim 15, wherein the notch portion is made of a non-conductive material.

19. The wireless communication device of claim 10, wherein a gap between the metallic frame and the mother-board is 2 mm.

* * * * *